US006175188B1

(12) United States Patent
Morimoto et al.

(10) Patent No.: US 6,175,188 B1
(45) Date of Patent: Jan. 16, 2001

(54) SEALING BODY FOR A DISCHARGE LAMP

(75) Inventors: Yukihiro Morimoto; Masanobu Komiya; Yukiharu Tagawa, all of Himeji (JP)

(73) Assignee: Ushiodenki Kabushiki Kaisha, Tokyo (JP)

( * ) Notice: Under 35 U.S.C. 154(b), the term of this patent shall be extended for 0 days.

(21) Appl. No.: 09/308,644

(22) PCT Filed: Sep. 28, 1998

(86) PCT No.: PCT/JP98/04328

§ 371 Date: May 28, 1999

§ 102(e) Date: May 28, 1999

(87) PCT Pub. No.: WO99/17339

PCT Pub. Date: Apr. 8, 1999

(30) Foreign Application Priority Data

Sep. 28, 1997 (JP) ..... 9-281223

(51) Int. Cl.[7] ..... H01J 61/36

(52) U.S. Cl. ..... 313/624; 313/625; 252/570; 585/6.3

(58) Field of Search ..... 313/624, 625; 252/570; 585/6.3

(56) References Cited

U.S. PATENT DOCUMENTS 4,959,587 9/1990 Schug .
4,959,588 * 9/1990 Vida et al. ..... 313/623 X (List continued on next page.)

FOREIGN PATENT DOCUMENTS 36 38 857 A1 5/1987 (DE) .
92 06 727 U 8/1992 (DE) .

(List continued on next page.)

OTHER PUBLICATIONS

Patent Abstracts of Japan, vol. 1996, No. 07, Jul. 31, 1996, & JP 08 077975 A (Ushio Inc.), Mar. 22, 1996, English Abstract.

(List continued on next page.)

* cited by examiner

*Primary Examiner*—Ashok Patel
(74) *Attorney, Agent, or Firm*—Nixon Peabody LLP; David S. Safran

(57) ABSTRACT

Sealing body for a discharge lamp which consists of a functional gradient material in which one side is rich in dielectric component and the other side is rich in electrically conductive component, and which is sealed by a side tube which is connected to the arc tube of the discharge lamp and by its areas which are rich in a dielectric component, characterized in that in this sealing body an upholding part of an electrode with a tip provided with an electrode is shrink-fitted, and that furthermore on the outer peripheral surfaces of the areas of the sealing body which are rich in dielectric component, surfaces are formed which run obliquely with respect to the center axis of the above described discharge lamp so that the maximum width of the end face of the sealing body on the side of the emission space becomes smaller than the maximum width in one direction perpendicular to the axis of the sealing body and becomes greater than the diameter of the upholding part of the electrode.

1 Claim, 3 Drawing Sheets

U.S. PATENT DOCUMENTS

| | | | | |
|---|---|---|---|---|
| 5,404,077 | * | 4/1995 | Eichelbronner et al. | 313/625 X |
| 5,424,608 | * | 6/1995 | Juengst et al. | 313/625 X |
| 5,455,480 | * | 10/1995 | Bastin et al. | 313/623 X |

FOREIGN PATENT DOCUMENTS

| | | |
|---|---|---|
| 36-22233 | 8/1961 | (JP) . |
| 48-62276 | 8/1973 | (JP) . |
| 61-284048 | 12/1986 | (JP) . |
| 8-190893 | 7/1996 | (JP) . |
| 10-125284 | 5/1998 | (JP) . |
| 10-172514 | 6/1998 | (JP) . |
| 10-188897 | 7/1998 | (JP) . |

OTHER PUBLICATIONS

Patent Abstracts of Japan, vol. 1996, No. 08, Aug. 30, 1996, & JP 08 096750 A (Toshiba Lighting & Amp; Technol Corp.), Apr. 12, 1996, English Abstract.

Patent Abstracts of Japan, vol. 008, No. 285 (3–287), Dec. 26, 1984, & JP 59 151745 A, (Mitsubishi Denki KK), Aug. 30, 1984, English Abstract.

Patent Abstracts of Japan, vol. 011, No. 254 (E–533), Aug. 18, 1987, & JP 62 064046 A (Toshiba Corp.), Mar. 20, 1987, English Abstract.

SEALING BODY FOR A DISCHARGE LAMP

TECHNICAL FIELD

The invention relates to a sealing body which is used for a discharge lamp. Description of related art In a discharge lamp in which there is a pair of electrodes opposite one another, recently a functional gradient material has been increasingly used as a sealing arrangement. In a sealing body of this functional gradient material one side is rich in a dielectric component and in the direction to the other side the proportion of electrically conductive component increases continuously or incrementally.

In a functional gradient material in which as the dielectric component silicon dioxide is used and as the electrically conductive component molybdenum is used, the silicon dioxide end has a coefficient of thermal expansion which is roughly equal to the coefficient of thermal expansion of the silicon dioxide which forms the arc tube, while the molybdenum end has the property that its coefficient of thermal expansion approaches the coefficient of thermal expansion of the tungsten or molybdenum which forms the upholding parts of the electrodes. These properties are suitable for the sealing body of a discharge lamp.

FIG. 7 is a schematic cross section of a discharge lamp in which a functionally gradient material is used. In the figure reference number 1 labels a discharge lamp with an arc tube 2 and side tube 3 consisting of a dielectric component (for example, silica glass). In arc tube 2 there is a pair of electrodes, i.e. a cathode 5 and an anode 6 opposite one another. The two electrodes are located on the tips of the upholding parts of the electrodes 7 which are inserted as far as the electrically conductive areas of the sealing bodies 4 and which are shrink-fitted. Outer leads 8 are connected to the sealing bodies 4. There are also cases in which the outer leads 8 are made in one piece with the upholding parts of the electrodes 7 and this one-part arrangement is penetrated by the sealing bodies 4 and is thus shrink-fitted.

The sealing bodies 4 consist of a dielectric component (for example, of silicon dioxide) and an electrically conductive component (for example, molybdenum). One side of the sealing body 4 (the side towards the arc tube) is rich in the dielectric component and is insulating, while the other side (the side away from the arc tube) is rich in the electrically conductive component and is electrically conductive.

The end face 9 on the side of the dielectric component is adjacent to the discharge space of the arc tube 2 of the discharge lamp 1. The side tube 3 formed on the two ends of the arc tube 2 is hermetically sealed (welded) in the areas of the sealing body 4 which are rich in the dielectric component.

The outside of the side tube is heated with a flame torch for this sealing of the side tube 3 with the sealing bodies 4 in the negative pressure state of the inside of the arc tube. In this way the side tube contracts. In this way sealing is effected. In doing so it is necessary to carry out heating until the outer peripheries of the sealing bodies and the inner periphery of the side tube are welded to one another enough to weld the side tube 3 and the sealing bodies 4 tightly to one another and to execute secure sealing. If however heating is done in this way it is impossible to prevent the silica glass which forms the arc tube from hanging from the face ends of the sealing bodies on the side of the emission space and thus hanging sites 10 from forming. In a discharge lamp with these hanging sites, depending on the amount and shape of the hanging silica glass, variations of the sustaining voltage occur during sealing.

DISCLOSURE OF THE INVENTION

Therefore the object of the invention is to reduce variations of the intensity of the sustaining voltage when the discharge lamp is sealed and therefore to devise a sealing arrangement of a discharge lamp which always has the desired intensity of the sustaining voltage.

As a result of extensive research the inventors have ascertained that variations of the intensity of the sustaining voltage by this sealing arrangement are largely influenced by the amount of the above described drooping and that it is advantageous if the amount of this hanging, i.e. the size of the aperture of the sites which are to be sealed and which are already closed by hanging, is kept constant.

If however formation of the hanging sites 10 progresses, the viscosity of the silica glass is extremely low, by which the progression is accelerated. It is therefore difficult to control the amount of hanging by controlling the arcing process with the torch. In this case the expression "aperture of the sites to be sealed" is defined as the width labelled with reference letter A in FIG. 7.

It was further ascertained that it is advantageous if areas of the sealing bodies on the side of the emission space which are rich in the dielectric component are tilted. Due to this arrangement the glass which forms the arc tube and which hangs down when the discharge lamp is sealed by melting flows slowly along the obliquely running surfaces.

Therefore constant hanging and constant openings of the sites to be sealed can be easily achieved and thus variations of the intensity of the sustaining voltage reduced.

As claimed in the invention a sealing body described below for a discharge lamp is given:

In a roughly cylindrical sealing body for a discharge lamp which consists of a functionally gradient material in which one side is rich in dielectric component and the other side is rich in electrically conductive component, and which is sealed by a side tube which is connected to the arc tube of the discharge lamp and by its areas which are rich in a dielectric component, the invention is characterized in that in this sealing body the upholding parts of the electrodes with tips provided with electrodes are shrink-fitted, and that furthermore on the outer peripheral surfaces of the areas of the sealing bodies which are rich in dielectric component, surfaces are formed which run obliquely with respect to the center axis of the above described discharge lamp so that the maximum width of the end faces of the sealing bodies on the side of the discharge space becomes smaller than the maximum width in one direction perpendicular to the axis of the sealing bodies and becomes greater than the diameter of the upholding parts of the electrodes.

BEST MODE FOR CARRYING OUT THE INVENTION

In the following a process for producing a sealing body with a functional gradient property is described:

Several types of mixed powder are prepared in which the mixing ratios of one powder with a dielectric component to a powder with an electrically conductive component are different. After mixing with a solvent which contains an organic binder, layers are assembled from the powder with a dielectric component and the powder with a electrically conductive component, placed on top of one another, and afterwards pressed. In this way a compacted body, for example a cylindrical body, can be formed.

Figure 4:
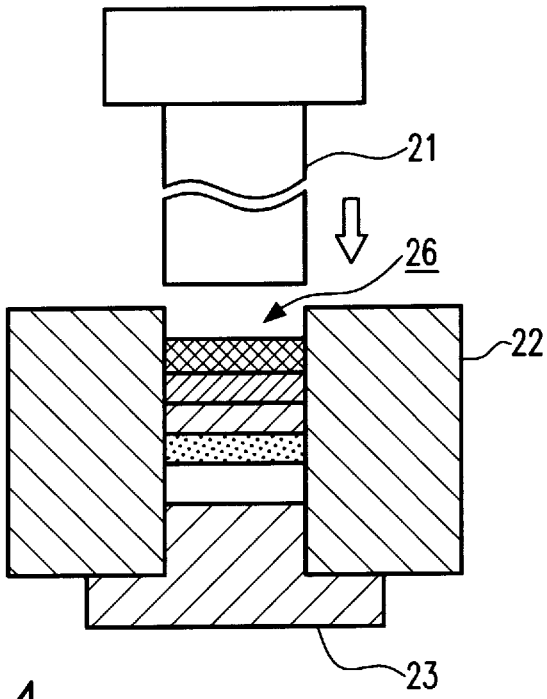
FIG. 4 shows a schematic of a process for producing a sealing body with a functional gradient property.
Figure 7:
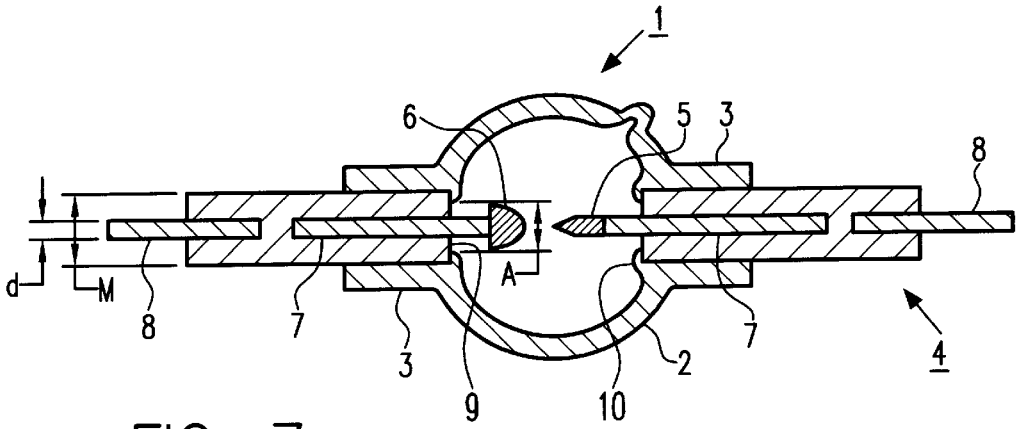
FIG. 7 shows a schematic of a conventional discharge lamp.

FIG. 4 shows the state in pressing of one such compacted body. In the cylindrical compacted body a bottom component 23 of a casting mold 22 is filled with a layer of the mixed powder with the lowest concentration of the electrically conductive component and then filled with a layer of the mixed powder with the second lowest concentration of electrically conductive component. In this way mixed powders in which the concentration of electrically conductive component have been incrementally changed are placed on top of one another. Afterwards molding is done with a press body 21. Thus a compacted body 26 is formed in which several layers are integrated. FIG. 7 shows for example a state of five layers. Then temporary sintering is done to remove the organic binder mixed with the powders.

After completion of temporary sintering the end face of the compacted body on the side of the dielectric component is provided essentially in the center with an insertion opening for the upholding part of the electrode, which extends as far as the area of the electrically conductive component. The upholding part of the electrode is inserted into this opening. In this state the entire unit is completely sintered.

Figure 1:
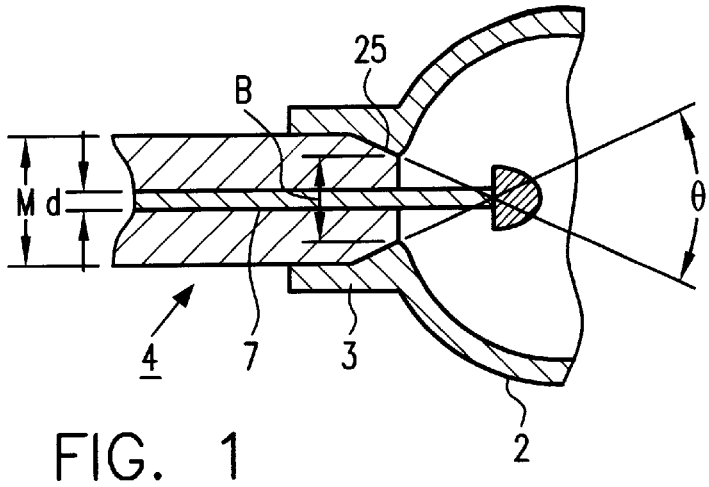
FIG. 1 shows a schematic of a discharge lamp for which a sealing body as claimed in the invention is used.
Figure 2:
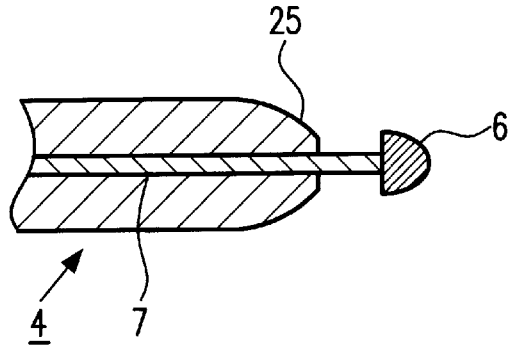
FIG. 2 shows a schematic of a discharge lamp for which a sealing body as claimed in the invention is used.
Figure 3:
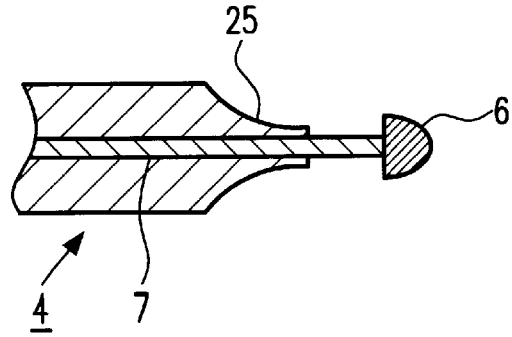
FIG. 3 shows a schematic of a discharge lamp for which a sealing body as claimed in the invention is used.

After complete sintering is finished the sealing body is essentially completed. Proceeding from this state the outer peripheral surface of the area which is rich in the dielectric component is scraped off. In this way the area of the tip can be formed to run obliquely. This means that a surface can be formed which is tilted with respect to the center axis of the discharge lamp. The area of the tip has the shape of the truncated cone, for example, as is shown in FIG. 1. But it can also have the shapes shown in FIGS. 2 and 3 or others.

Figure 5:
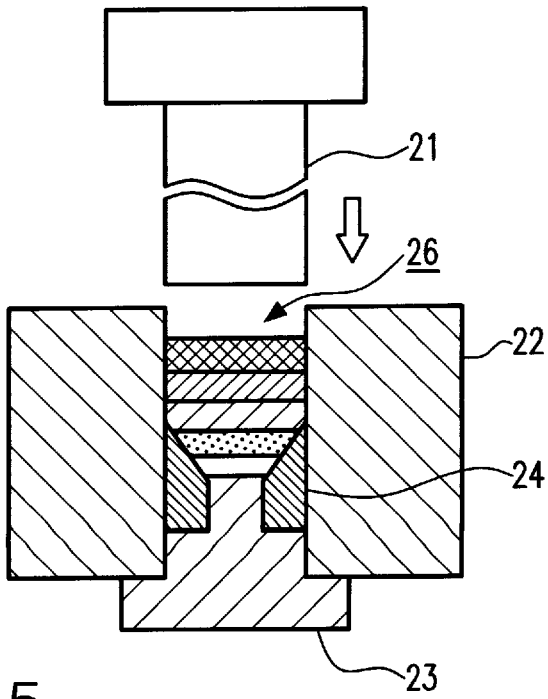
FIG. 5 shows a schematic of a process for producing a sealing body with a functional gradient property.

To form an obliquely running surface, besides the above described process, a casting mold component 24 produced beforehand can be used to obtain a corresponding shape, as is shown for example in FIG. 5. When the tip of the sealing body is provided with the tapering, obliquely running surface shown in FIG. 4 the casting mold component 24 shown in FIG. 5 is used for tapering of the tip. In the case of the obliquely running surface shown in FIG. 2 in the form of a cannonball or in the case of the obliquely running surface shown in FIG. 3 in the form of an arc, a casting mold with the corresponding shape can be used.

The finished sealing bodies are used for sealing on the side tube of the discharge lamp by a flame torch.

In FIG. 1 the width labelled B represents the maximum width of the end faces of the sealing body on the sides of the dielectric component. The width labelled M represents the maximum width in the direction perpendicular to the center axis of the sealing body. Furthermore, the diameter of the upholding parts of the electrodes is labelled d.

In the sealing body as claimed in the invention, $d<B<M$. When the hanging sites reach the end faces on the sides of the dielectric component, reference number B agrees with aperture A of the point to be sealed as shown in FIG. 7.

In the following the invention is described using specific examples.

In the functional gradient material silicon dioxide was used as the dielectric component and molybdenum as the electrically conductive component.

Molybdenum powder with an average grain size of 1.0 microns and a silicon dioxide powder with an average grain size of 5.6 microns were prepared and mixed powders with altered volumetric ratios of silicon dioxide were produced. These mixed powders were mixed with stearic acid, by which a granulate was obtained, and they were placed on top of one another in a casting mold in the sequence of a larger volumetric ratio of silicon dioxide. Proceeding from this state compression was done with a press body for example with a load of 1.5 t/cm$^2$ and thus a compacted body with an essentially cylindrical overall shape was obtained. Afterwards the compacted body was temporarily sintered in a hydrogen atmosphere for example at 1200° C. for 30 minutes, and in this way the organic binder contained therein was removed.

Next, the end face of the compacted body on the side of dielectric component was provided with an opening. A tungsten upholding part of the electrode was inserted into this opening and sintered for five minutes in a vacuum atmosphere for example at 1820° C. In this way the upholding part of the electrode was completely sintered as it was shrunk.

After this complete sintering a sealing body with a property as the functionally gradient material is essentially finished. In this state the side of the dielectric component (silicon dioxide) was cut in such a manner that it runs obliquely. Specifically the maximum width of the end face was made smaller than the maximum width in the direction perpendicular to the center axis of the sealing body and larger than the diameter of the upholding part of the electrode. For processing, the sealing body was machined on a lathe and cut obliquely with the cutting edge of a superhard cutting tool, and thus a stipulated shape of the obliquely running surface was formed.

In the following the result of the test is described with respect to the intensity of the sustaining voltage of the discharge lamp when using a sealing body with a functionally gradient property produced in this way.

The maximum width of the sealing body is 3 mm. The total length of the sealing body is 15 mm. The above described cutting yielded six different sealing bodies in five pieces each, in which the maximum width of the silicon dioxide end face was 0.5 mm, 0.8 mm, 1.0 mm, 1.5 mm, 2.0 mm or 2.4 mm.

As was shown in FIG. 1, the angle (Θ) of the obliquely running surface formed by cutting was changed, depending on the types of lamps, in the range from 5° to 150°. In this embodiment it was kept constant at 45° (this process of staggering is hereinafter called "tapering").

The respective sealing body was sealed on one side of a glass bulb for a mercury lamp with 150 W. Sealing was done by the sealing body being located in the arc tube and degassed, by the side tube being heated from the outside with the torch flame, and by the inner wall of the side tube being welded to the sealing body. The diameter of the upholding parts of the electrodes was 0.4 mm.

Furthermore five conventional cylindrical sealing bodies of a functionally gradient material were likewise prepared and sealed on one side of the glass bulb for a mercury lamp with 150 W.

The intensity of the sustaining voltage of the sealed discharge lamp at room temperature in the invention was compared to the conventional example.

This experiment was done such that the glass bulb for a unilaterally sealed lamp was filled with nitrogen gas in steps by pressing and that the pressure at which the glass bulb was destroyed was determined.

Figure 6:
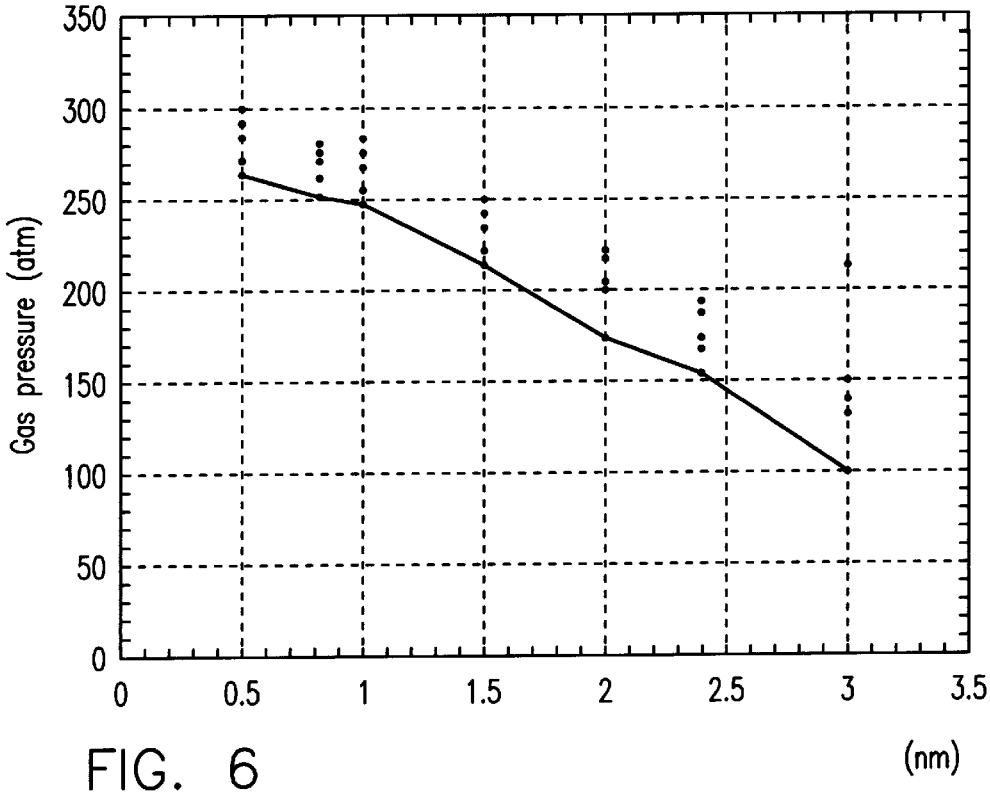
FIG. 6 shows a schematic of the action of the invention.

FIG. 6 shows the test result. The X-axis plots the maximum value (mm) of the face of the sealing body on the side of the dielectric component and the y-axis plots the gas pressure (atm) within the discharge lamp. The sealing body was provided with an obliquely running surface. The embodiments of the invention in which the width of the end face on the silicon dioxide side was changed are shown at 0.5 to 2.4 of the x-axis, while the conventional examples using the sealing bodies which do not have an obliquely running surface are shown at 3.0 of the x-axis. The individual examples indicate variations of data with respect to the y-axis. This indicates that the lamps as claimed in the invention, i.e. the discharge lamps, in which tapered sealing bodies were used, have fewer variations of the intensity of the sustaining voltage than conventional lamps, i.e. the discharge lamps using the sealing bodies which are not tapered.

In FIG. 6 the points with the lowest intensity among the data of the respective maximum width of the silicon dioxide end face are joined using the solid line. This shows that the intensity of the sustaining voltage increases more, the smaller the maximum width of the silicon dioxide end face. For example, at a maximum width of the silicon dioxide end face the intensity of the sustaining voltage was 0.5 mm at 262 atm and at 2 mm it was 175 atm. This shows that the intensity is far greater than that in the sealed areas in which conventional sealing bodies of a functionally gradient material with a diameter of 3 mm with large variations are used.

In the above described experimental examples sealing bodies with the arrangement shown in FIG. 1 and an angle (Θ) of the obliquely running surface of 45° degrees were used. It was however confirmed that in the sealing bodies produced experimentally with different angles (Θ), specifically in the range from 5 to 150°, i.e. with 5°, 40°, and 150°, an effect was obtained in each case.

The formation of hanging sites of silica glass on the inside of the side tube can be easily controlled in this way by formation of an obliquely running surface, such as a tapered surface or the like, on the ends of the sealing bodies. In the hermetically sealed areas of the discharge lamps the variations of the intensity of the sustaining voltage can be reduced.

On the other hand, the reason why the intensity of the sustaining voltage has increased more, the smaller the maximum width of the end face on the side of the dielectric component, is presumably the increase in the thickness of the area with the greatest thickness of the inside wall of the side tube.

If a sealing body is used with the maximum width of the end face on the silicon dioxide side which is equal to the diameter of the upholding parts of the electrodes, there is the danger that the hanging sites formed by melting of the silica glass on the inside wall of the side tube will come into contact with the upholding parts of the electrodes. Upon contact, as a result of the difference between the coefficient of linear expansion of the upholding parts of the electrodes and the silica glass or due to the temperature increase of the contact sites during operation of the lamp, cracks form in the silica glass of the inside wall of the side tube; this leads to a reduction in the intensity of the sustaining voltage during sealing.

As was described above, the intensity of the sustaining voltage when the discharge lamp is sealed is increased by the outer peripheral surface of the area of the sealing body which is rich in silicon dioxide being provided with a surface tilted with respect to the center axis of the sealing body, so that the maximum width of the end face on the silicon dioxide side of the sealing body becomes less than the maximum width in the direction perpendicular to the center axis of the sealing body and becomes greater than the diameter of the upholding parts of the electrodes.

In the above described embodiments sealing bodies with a functionally gradient property were described in which silicon dioxide and molybdenum are combined. However aluminum oxide, zirconia, magnesium oxide, silicon carbide, silicon nitride, titanium carbide, or the like are used as the dielectric component. Furthermore nickel, tungsten, tantalum, chromium, platinum or the like can be used in practice as the electrically conductive component.

As was described above, by means of the sealing body as claimed in the invention, variations of the intensity of the sustaining voltage can be reduced when the discharge lamp is sealed and furthermore discharge lamps as products can be made more uniform. In addition, increasing the pressure of the added gas compared to that in a discharge lamp in which a cylindrical sealing body of conventional functionally gradient material is used enables a lamp with higher light radiance.

Commercial application

As was described above, the sealing body as claimed in the invention can be used to advantage for a discharge lamp such as a metal halide lamp, a mercury lamp or the like.

What we claim is:

1. Sealing body for a discharge lamp which consists of a functional gradient material in which one side is rich in a dielectric component and the other side is rich in an electrically conductive component, and which is sealed by a side tube which is connected to the arc tube of the discharge lamp and by its areas which are rich in a dielectric component, characterized in that in the sealing body an upholding part of an electrode with a tip provided with an electrode is shrink-fitted, and that furthermore on the outer peripheral surfaces of the areas of the sealing body which are rich in dielectric component, surfaces are formed which run obliquely with respect to the center axis of the discharge lamp, so that the maximum width of the end face of the sealing body on the side of the emission space becomes smaller than the maximum width in one direction perpendicular to the axis of the sealing body and becomes greater than the diameter of the upholding part of the electrode.

* * * * *